United States Patent [19]

Rees

[11] 3,970,042

[45] July 20, 1976

[54] COLOR DEVELOPMENT APPARATUS

[75] Inventor: James D. Rees, Pittsford, N.Y.

[73] Assignee: Xerox Corporation, Stamford, Conn.

[22] Filed: Jan. 17, 1975

[21] Appl. No.: 541,773

[52] U.S. Cl. ..... 118/637; 355/4

[51] Int. Cl.[2] ..... G03G 15/01; G03G 15/08

[58] Field of Search ..... 118/637; 355/4; 96/1.2; 427/16, 21

[56] References Cited

UNITED STATES PATENTS

| | | | |
|---|---|---|---|
| 3,672,884 | 6/1972 | Mayer | 118/637 |
| 3,705,767 | 12/1972 | Tamai et al. | 118/637 |
| 3,724,943 | 4/1973 | Draugelis et al. | 355/4 |
| 3,797,930 | 3/1974 | Tanaka et al. | 355/4 |
| 3,832,170 | 8/1974 | Nagamatsu et al. | 355/4 |
| 3,838,919 | 10/1974 | Takahashi | 355/4 |
| 3,848,566 | 11/1974 | Stange | 118/637 |
| 3,854,449 | 12/1974 | Davidson | 118/637 |

*Primary Examiner*—Mervin Stein
*Assistant Examiner*—Douglas Salser

[57] ABSTRACT

A multi-color electrostatic printing machine having processing components to produce either a color or black and white copy of an original. Individual development rollers, one for color and one for black and white, are moved into contact with a photoconductor to develop latent electrostatic images thereon for either a color or black and white copy. Toner donor apparatus spaced about the periphery of the color development roller supply the latter with color toner and additional toner donor apparatus supplies the black development roller with black toner. Each developed color image is transferred in superimposed relationship on sheets of paper.

8 Claims, 8 Drawing Figures

BLACK & WHITE MODE

COLOR DEVELOPMENT APPARATUS

This invention relates to a reproduction system and more particularly to an electrostatic reproduction system having components arranged and programmed to effect automatically the high speed production of color or black and white copies of an original.

In recent years considerable interest has been shown in the development of electrostatic color reproduction systems employing charging, imaging, developing and transfer techniques for color copies similar to that used in black and white reproduction. These color reproduction systems generally use a panchromatic photoconductor drum, such as is used in the Xerox 6500 machine, arranged to be moved rotationally through the several charge, exposure, development and transfer stations. Each original being reproduced or copied is subjected to a series of successive, multiple exposures, and a light filter device, having a separation color filter for each color desired to be reproduced, is utilized and arranged to present one filter during each of the exposures so that the original is exposed once for each color rendition. At the development station there is provided a plurality of developer devices each of which is adapted to develop successively an image with a subtractive color toner. Each developed color rendition is then transferred successively to a final support medium.

In view of the wide acceptability and commercial success of electrostatic black and white reproduction systems utilizing a rotating drum photoreceptor, it would be advantageous to convert these drum type black and white machines to include also a color reproduction capability. The basic color reproduction techniques mentioned above are suitable for providing quality renditions of color originals; therefore, it also would be desirable to incorporate these features in the black and white drum type copier. One problem in modifying such drum type black and white reproduction systems to incorporate color copy capability relates to the size of the photoreceptor drum which generally is less than 10 inches in diameter. This problem is simply how to orient each of the color toner development stations plus one black toner development station about the drum where previously only one black toner station existed. In conventional color reproduction systems for producing good color renditions different colors are used, thereby requiring as many as four development stations in a system having capacity for both color and black and white reproductions.

In one electrostatic color reproduction system a "ferris wheel" type development is used in which three separate color developers are rotated in a ferris wheel fashion to develop successively the latent images on a photoconductive drum. In addition to being mechanically complex, this ferris wheel technique severely limits the copying rate. This is due, in part, because of the relatively large amount of movement, time and displacement needed to rotate a developer into position for developing the image.

Magnetic brush and nap fur brush development systems are among the smallest known systems. However, neither is small enough for four development stations to be placed in series around the available drum periphery of any reasonably sized drum type copier machine.

It is an object of the present invention to provide an electrostatic copying system having both color and black and white reproduction capabilities in a novel arrangement and programmed to effect reproduction at high speed.

It is a further object of the present invention to produce color and black and white images from a colored original utilizing a minimum of space and time.

Another object of the present invention is to utilize a color development roller for applying different colors sequentially to a photoconductor, particularly a drum type photoconductor.

A still further object of the invention is to provide a color development roller for applying color toner to a photoconductor in which different colors are segmented on the development roller and do not overlap each other.

Another object of the invention is the provision of a second developer roller for applying a fourth color, specifically black, to the photoconductor for producing black and white copies of an original.

A yet further object of the invention is to employ nap fur brush development techniques at the several development stations.

These and other objects of the present invention are obtained by means of two separate rotatable development rollers, one for color copying and one for black and white copying. The development rollers are arranged to move into and out of contact with a rotating photoconductor to apply toner to the drum. During color reproduction, donor rollers, one for each of the desired colors, and spaced about the periphery of the color development roller, are individually moved into and out of contact with the color development roller to apply toner to specified areas of such development roller. The color development roller, which is in contact with the photoconductor while the black development roller is spaced apart therefrom, transfers each color toner to separate areas of the photoconductor. At the transfer station the color toner is transferred successively to a final support material.

In the black and white reproduction process, at the development station a black donor roller transfers black toner to the black development roller which is in contact with the photoconductor while the color development roller is spaced apart therefrom. At the transfer station the black toner is transferred to the final support medium.

For a better understanding of the invention as well as other objects and further features thereof, reference is made to the following detailed description of the invention to be read in conjunction with the accompanying drawings.

Figure 1:
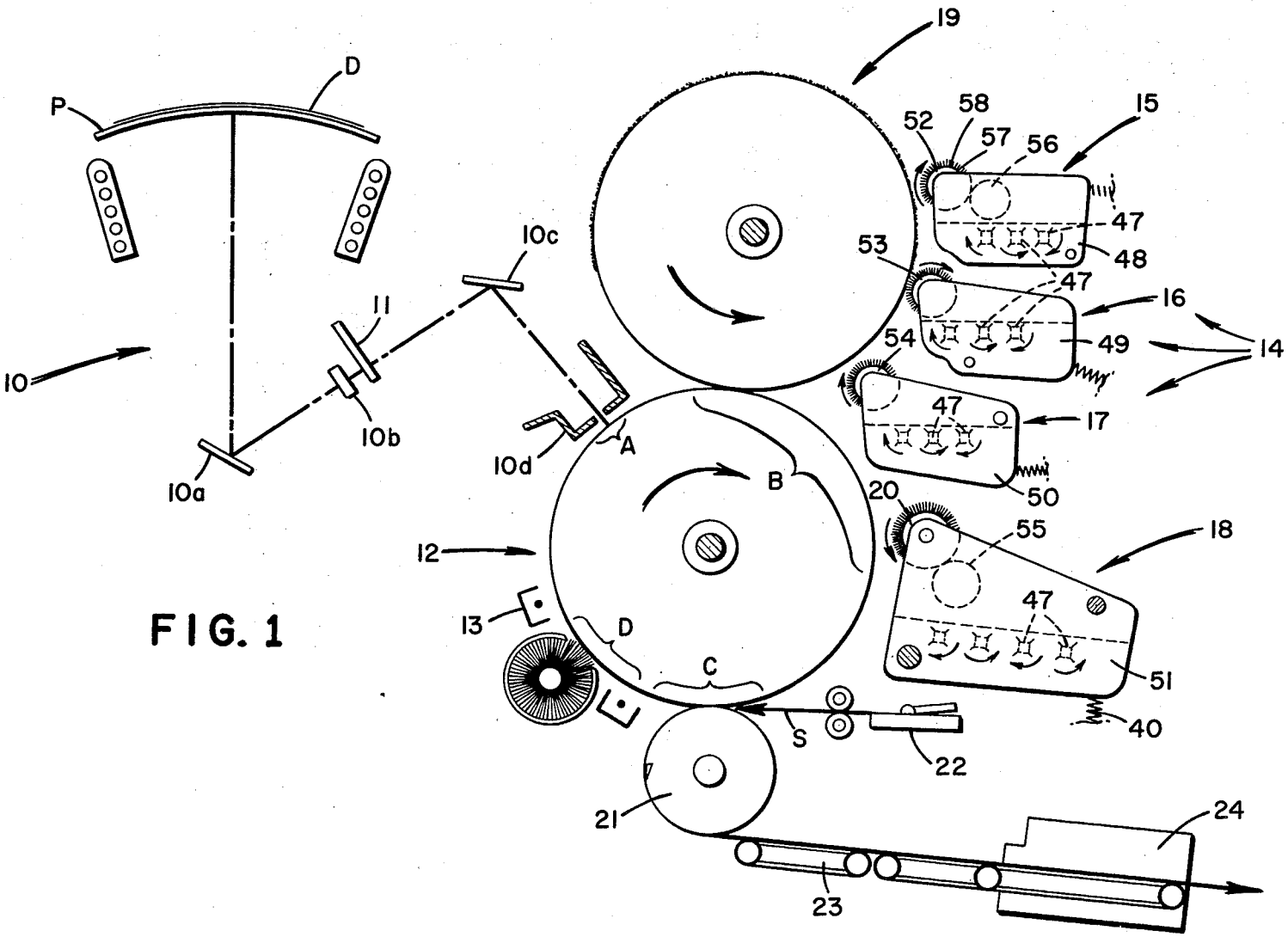
FIG. 1 is a schematic view of a reproduction machine showing various electrostatic processing components.

For a general understanding of the illustrated copier/reproduction machine, reference is had to FIG. 1 in which the various components for the machine are schematically illustrated. As in all electrostatic systems as well as a xerographic machine of the type illustrated, a light image of a document to be reproduced is projected onto the sensitized surface of a xerographic plate to form an electrostatic latent image thereon. Thereafter, the latent image is developed to form a xerographic powder image, corresponding to the latent image of the plate surface. The powder image is then electrostatically transferred to a support surface to which it may be fixed by a fusing device whereby the powder image is caused permanently to adhere to the support surface.

In the illustrated machine, a stationary colored original D to be copied is placed upon a transparent support platen P fixedly arranged relative to an optical scanning or projection system 10 positioned as viewed in FIG. 1. The scanning or projection system, such as is disclosed in U.S. Pat. No. 3,221,622 issued to Aser et al. provides a flowing image onto the photosensitive surface of a xerographic plate, particularly rotatable photoconductive drum 12, from the original. Scanning of the original is accomplished by means of a mirror assembly, which is oscillated relative to the original in timed relation to the photoconductive drum. The mirror assembly which includes an object mirror 10*a*, is mounted below the platen to reflect an image of the original through a lens system 10*b* onto an image mirror 10*c* which, in turn, reflects the image onto the xerographic drum 12 through a slot in a fixed light shield 10*d* positioned adjacent to the surface of drum 12. Separation filters, shown generally at 11 and described more fully hereinafter, act on the image rays to expose the surface of drum 12 at exposure station A with rays which correspond to the color information areas of the original.

The photoconductive drum 12 may be mounted upon the frame of the machine and is adapted to rotate at a constant rate in the direction of the arrow as shown in FIG. 1. As noted, during this movement of the drum 12, the light imaging rays from the original D are scanned upon the surface of the drum. The drum 12 may comprise a layer of photoconductive insulating material such as selenium on a conductive backing that is sensitized prior to exposure by means of a suitable charging corona generator device 13.

The exposure of the photoconductive surface to the light image discharges the photoconductive layer in the areas struck by light, whereby there remains on the drum an electrostatic latent image for each exposure. Each exposure results in an image configuration corresponding to the light image projected from the original D on the supporting platen P through a corresponding separation filter. As the photoconductive surface continues its movement, the latent electrostatic images pass through a developing station B at which there is positioned a developer assembly generally indicated by the reference numeral 14. The developer assembly 14 comprises a plurality of developing units including toner donor apparatus 15, 16, 17, 18, each of which contains a different color developing material to provide individual development of the electrostatic images. The developer assembly also includes two development rollers 19, 20 for color and black toner, respectively. The development rollers 19, 20 also are mounted on the frame of the machine and the apparatus 18 respectively and rotate at a constant rate in the direction shown by the arrows.

The successively developed electrostatic images are transported by the drum 12 to a transfer station C whereat a sheet of copy paper is moved at a speed in synchronism with the moving drum in order to accomplish transfer of the developed images. There is provided at this station C a sheet transport mechanism in the form of a transfer drum 21 adapted to support a sheet of paper and to carry the same into image transfer relationship with the drum 12 once for each image transfer operation, as will be described in more detail hereinafter. A sheet of paper S from a paper handling mechanism, generally indicated by the reference numeral 22, is transported into position upon the drum 21 where it is supported during the image transfer function. The transfer of the developed image from the drum 12 to sheet material S is effected by means of an electrical bias of the opposite polarity as the electrostatic charge on the developing particles utilized in image development. This electrical bias is applied to the transfer drum 21 at the point of contact between the sheet S and selenium drum 12 as the sheet passes the transfer station C.

After the sheet is stripped from the transfer drum 21 it is conveyed by conveyor 23 into a fuser assembly generally indicated by the reference numeral 24 wherein the developed and transferred powder image is permanently affixed to the sheet S. After fusing, the finished copy is discharged at a suitable point for collection externally of the machine. The drum 12 is then cleaned of residual toner at a cleaning station D.

As previously stated, in order to effect development of each of the latent electrostatic images on the photoconductive drum 12 that comprise a series of exposures of a single original, the development assembly 14 includes four toner donor apparatus 15, 16, 17, 18 and two development rollers 19, 20. Each of the toner donor apparatus 15, 16, 17, which supplies color toner, is activated individually and sequentially to apply color toner to the color development roller 19. The toner donor apparatus 18, which stores black toner, is in continuous contact with the black development roller 20 to apply toner to the latter. One of the development rollers 19, 20 will be activated to coact with the photoconductive drum 12 while the other development roller is rendered inactive so as not to interfere with the developing process of the activated roller, depending on whether a color or black and white copy is desired. At the development station B, each latent electrostatic image on the surface of the drum 12 is developed to form a powder image of a particular color in image configuration corresponding to that color component in the original.

For color copying, the electrostatic copier machine employs the subtractive color reproduction process utilizing separation filters blue, green and red and no filter for black and white reproduction. With the drum 12 being a panchromatic photoconductor, subtractive acting toners yellow, magenta and cyan are utilized respectively to effect development of the latent electrostatic images produced in conjuction with the separation filters blue, green and red. A more detailed discussion of the exposure station will be given below.

For color reproduction, the original D is exposed three times, thereby producing three electrostatic images in seriatim on the surface of the drum 12. Each of the three latent images is representative of a particular color in the original D. The spacings of the three latent images on the drum 12 may be fairly close and are determined, in part, by the diameter of the drum 12 and the programming system of the machine.

As indicated previously, for color reproduction the color development roller 19 will be in contact with drum 12 while the black development roller 20 will be separated from the drum 12. As the lead electrostatic image is moved into the developing station B, the color development roller 19 will provide development with a subtractive toner relative to the separation filter used for the exposure of this image. For example, if the lead latent image is produced from the exposure of the original through a blue filter, this image will be developed by means of the development roller 19 applying yellow color toner particles to provide yellow development. By the particular timing of the machine, in the illustrative example being described, color donor apparatus 15 will have moved into contact with color development roller 19 to apply yellow toner thereto at a time such that this area of yellow toner on the roller 19 will have been rotated to register with the electrostatic image obtained through the blue filter.

After the first electrostatic image has been developed and moves out of influence with the color development roller 19, the second latent image immediately behind the first image is moved into the development station B. This second image may be produced by means of illumination of the original through a green filter and is developed with magenta color toner particles. Again, as with the yellow color toner, the color donor apparatus 16 will have moved into contact with color development roller 19 to apply magenta color toner thereto at a time such that the area of magenta toner on the roller 19 will have been rotated to register with the electrostatic image obtained through the green filter. In a similar manner as with the development of the first and second latent electrostatic images, a third electrostatic image is produced and developed by means of illumination of the original through a red filter and development with cyan color toner particles stored in donor apparatus 17.

The three color powder images successively applied to the drum 12 also are transferred in succession to a sheet of support material mounted on the transfer drum 21. For color reproduction the transfer drum is capable of recirculating the sheet of support material through three transfer cycles to transfer the three color powders in proper registration onto such material.

In the event that black and white copies of the original are desired, the color development roller 19 is moved out of contact with drum 12 and the black development roller 20 moved into contact with the drum. Electrostatic latent images are produced on the drum 12 by illumination of the original without any filter. Alternatively, such images can be produced with a spectrally neutral filter. These electrostatic images are developed at station B by black development roller 20 which has applied to it black toner particles from black donor apparatus 18. For black and white reproduction, the transfer drum 21 need hold the support material for only one transfer cycle to transfer black toner powder to the material. A suitable transfer drum 21 for providing proper registration and support of the materials for either color or black and white reproduction is disclosed in U.S. Pat. No. 3,724,943 by Draugelis et al. and assigned to the assignee of the present invention.

The present invention lends itself most readily to a standard Xerox 2400 drum type black and white reproduction system which is capable of producing 2400 copies per hour. The Xerox 2400 machine inherently is constructed so that three developed images are separated and equally spaced around the periphery of a photoconductive drum, like drum 12. As noted previously, as the machine is operating, the three color images on drum 12 are transferred in registration onto a single sheet of support material tacked to the transfer drum 21 whose circumference is ⅓ that of drum 12. Hence, one color copy is produced per revolution of the drum resulting in a maximum color copy rate of 800/hr. For black and white reproduction, the present invention operates essentially like a standard Xerox 2400 machine. Three black and white electrostatic images are placed on drum 12 thereby producing three copies per drum revolution or 2400/hr. The present invention can also be applied to the Xerox 3600 machine with appropriate changes in black and white and color copy rates.

As illustrated and as will be more fully described, the diameters of the color development roller 19 and drum 12 are equal and are rotated at the same speed. Furthermore, toner donor apparatus 15 always applies its color toner to a first area of development roller 19, donor apparatus 16 always applies its color toner to a second area of the roller 19 separated from the first area and toner donor apparatus 17 always applies its color toner to a third area of the roller 19 separated from the first and second areas. Hence there will be no mixing of color toners on the roller 19 or the drum 12. Because of this lack of contamination of different colors on the same area of the drum 12 and roller 19, the former need not be cleaned at the cleaning station D as critically as would be necessary if such color contamination did occur. The color development roller 19 need not be cleaned at all.

Figure 2A:
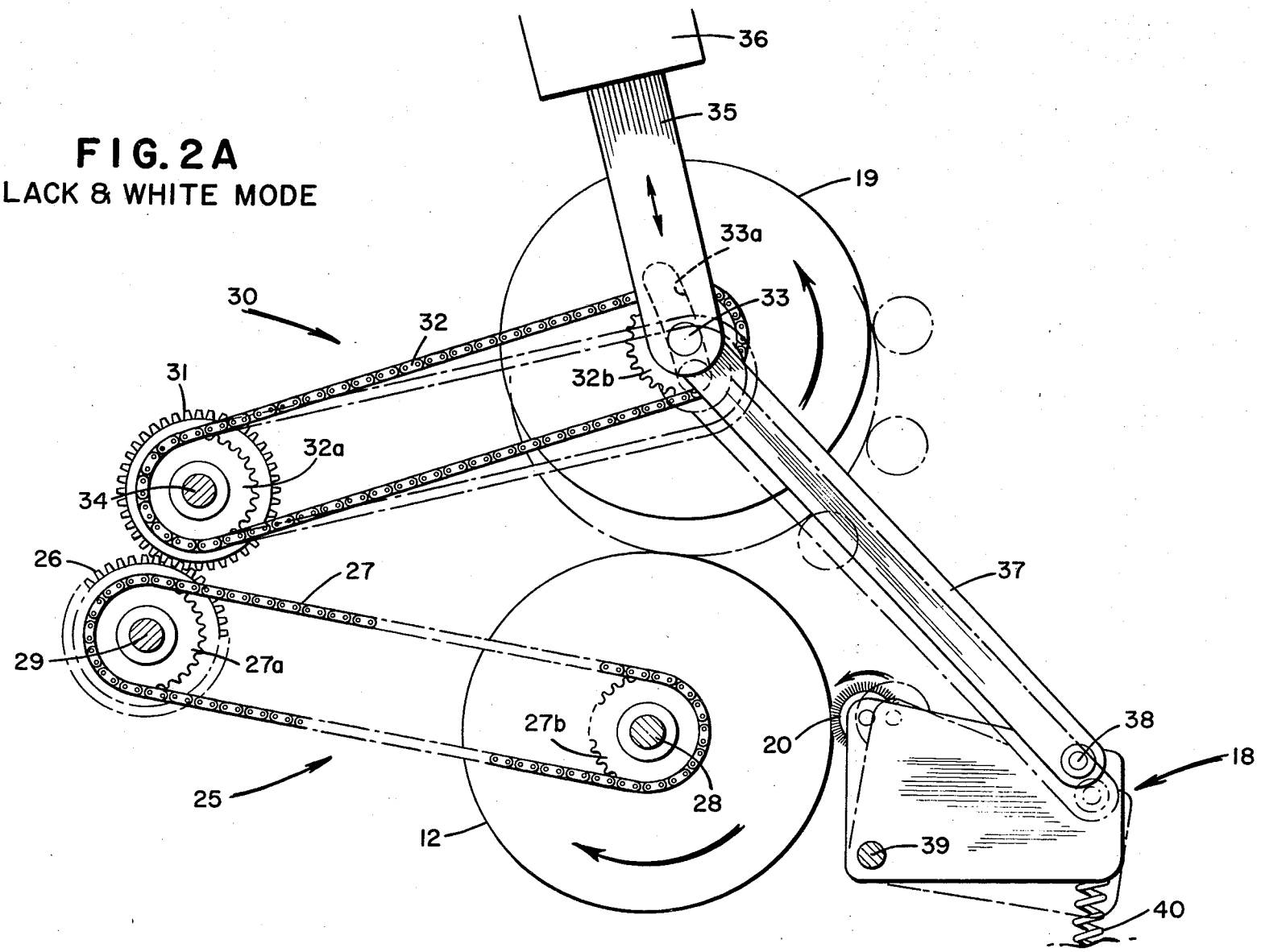
FIG. 2A is a schematic view of the drive system for the color development roller and the photoconductive drum as well as linkage for changing from either the black and white or color copying mode.
Figure 2B:
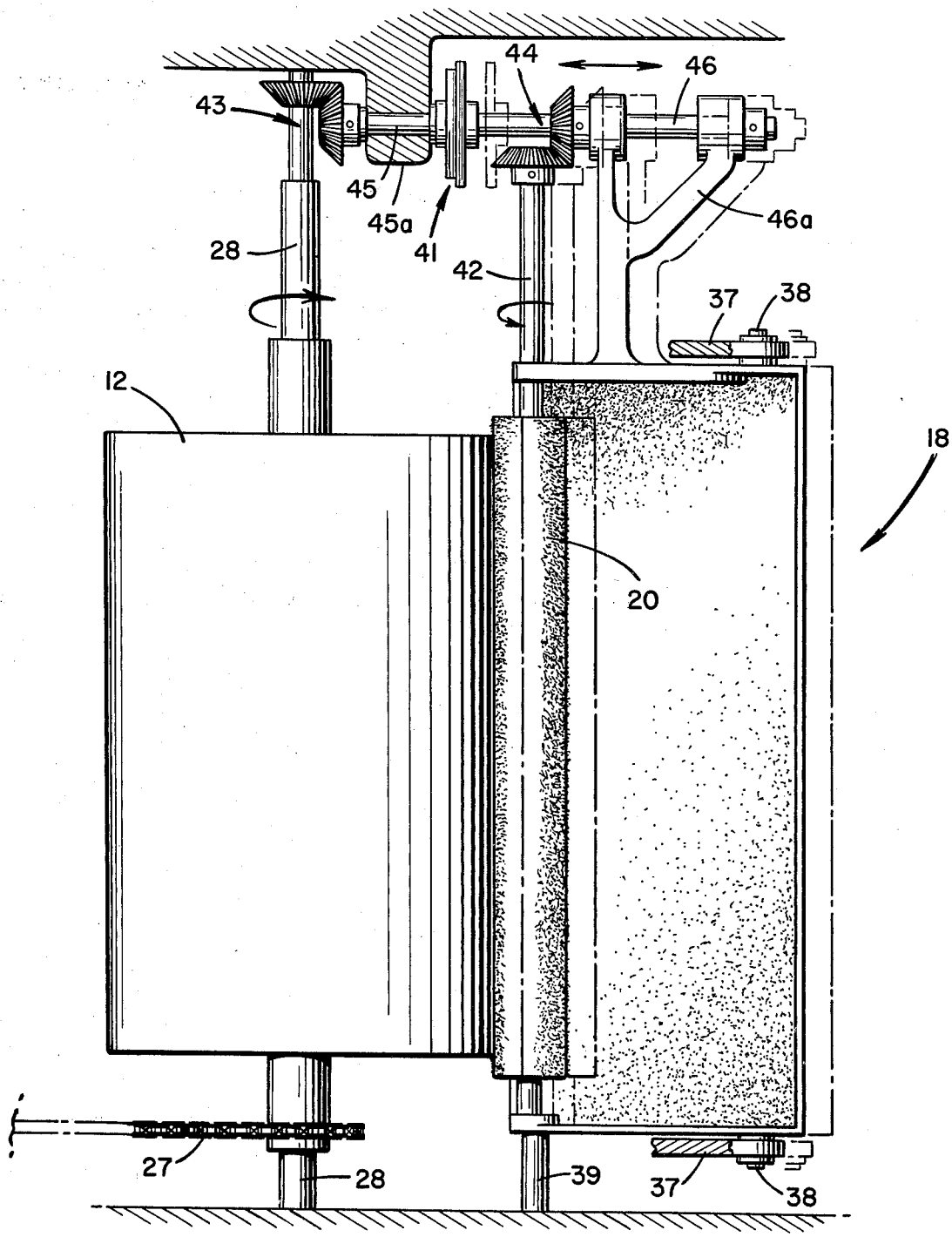
FIG. 2B is a top plan view of the photoconductive drum and black toner development roller illustrating schematically a drive train for the drum and roller.

FIGS. 2A and 2B illustrate the drive mechanism of the present invention for the photoconductive drum 12, development rollers 19, 20 and the linkage for switching from one mode of copying, e.g. black and white, to the other or color mode. As shown in FIG. 2A, the photoconductive drum 12 and development roller 19 are geared in a 1:1 ratio to be rotated at the same speed. A first assembly 25 including a gear 26, chain 27 and sprockets 27*a, b* is connected at one end via chain 27 and sprocket 27*b* to a rotatable shaft 28 rotatably supporting the drum 12 and at the other end via gear 26, chain 27 and sprocket 27*a* to a rotatable drive shaft 29 driven by a motor (not shown). A second assembly 30 including a gear 31, chain 32, and sprockets 32*a*, 32*b* is connected at one end via chain 32 and sprocket 32*b* to a rotatable shaft 33 rotatably supporting the development roller 19 and at the other end via gear 31, chain 32 and sprocket 32*a* to a rotatable shaft 34 driven by shaft 29 through gears 26, 31. Shaft 33 also is capable of movement up and down in a substantially vertical direction as viewed in FIG. 2A. With vertical movement of shaft 33, the assembly 30 pivots about shaft 34, the gears 26, 31 remaining in contact to maintain a 1:1 drive. By driving drive shaft 29 with the motor (not shown) both shafts 28, 33 will be driven at the same speed due to gears 26, 21, thereby rotating the drum 12 and development roller 19 at equal speeds but in opposite directions.

The mechanism for changing from one mode of copying to the other includes a first movable link 35 connected at one end to shaft 33 movable in arcuate slot 33*a*. The other end of link 35 may be operatively connected to a solenoid 36 which, when energized, will move link 35 and hence shaft 33 in the substantially vertical direction. Solenoid 36 may be energized by a circuit (not shown) which is closed by the operator pressing a button located on the frame of the machine. Alternatively, link 35 may be moved manually by the operator by extending the link through the frame of the machine.

A second link 37 also has one end connected to shaft 33 to be moved substantially vertically therewith. The other end of link 37 is coupled to the housing of black donor apparatus 18 by a pin 38. Donor apparatus 18 is pivotally mounted to the frame of the machine about shaft 39 while donor roller 20 is rotatably connected to the housing of apparatus 18. A spring 40 connected to the housing of apparatus 18 biases the housing to maintain donor roller 20 in contact with drum 12 during the black and white copying mode.

As shown in FIG. 2B, the black development roller 20 is driven by the rotating shaft 28 of the photoconductive drum 12. To drive roller 20 a clutch mechanism 41 transmits rotational movement of the shaft 28 to a shaft 42, rotatably journeled within housing 18, via a set of bevel gears 43, 44 to which it is connected through shafts 45, 46. Shaft 45 is rotatably journeled within the stationary housing of the machine at 45*a*. Shaft 46 is rotatably journeled to a bracket 46*a* attached to the side of apparatus 18.

For black and white copying, solenoid 36 is energized to raise link 35, thereby lifting shaft 33 a small vertical distance. This upwards movement of shaft 33 will remove color development roller 19 from contact with photoconductive drum 12. At the same time link 37 will be raised due to its connection with shaft 33 to rotate development apparatus 18 and, hence, donor roller 20 about shaft 39 to bring roller 20 into contact with drum 12. This movement of roller 20 now will cause shaft 42, bevel gear 44, shaft 46 and bracket 46*a* to move as a unit with donor apparatus 18 causing clutch 41 to become engaged. This will impart rotation of the shaft 42 from drive shaft 28 through bevel gear 43 and shaft 45.

For color copying, solenoid 36 is deenergized, thereby lowering link 35, shaft 33 and link 37. Consequently, color development roller 19 will be moved into contact with photoconductive drum 12 while development apparatus 18 will be rotated clockwise about shaft 39 to separate black donor roller 20 from photoconductive drum 12. This movement of apparatus of apparatus 18 also will cause the clutch mechanism 41 to disengage to uncouple shaft 28 from shaft 42 and cease rotation of the latter.

Each of the development apparatus 15, 16, 17 and 18 may be of the magnetic brush or nap fur brush type, though the latter is preferable and will be described in greater detail. If the former is used development roller 20 may be a magnetic brush, however, roller 19 should not be, but may be a nap fur brush. Toner donor apparatus 15, 16, 17 and 18 are similar, as viewed in FIG. 1, in that they each have a plurality of paddle wheels 47 which rotate in respective developer beds 48, 49, 50 and 51 having yellow, magenta, cyan and black color toner respectively. In addition, each of the apparatus has a respective donor roller 52, 53, 54 and 55 supplying color development roller 19 with color toner and black development roller 20 with black toner. Toner donor apparatus 15 differs from the others in the use of an intermediate roller 56 located between paddle wheels 47 and yellow donor roller 52. This intermediate roller 56 would be needed due to space requirements in a standard Xerox 2400 drum type machine to locate the yellow donor roller 52 in proximity to the color development roller 19. Otherwise, a relatively large diameter yellow donor roller 52 would be needed, as well as additional space in the Xerox 2400 machine.

In the nap fur brush development technique each of the donor rollers 52, 53, 54 and 55, the two development rollers 19, 20 and the intermediate roller 56 comprises a rotatable biased metal core and brushes of, for example, a nylon fibre with a rayon back such as that shown by reference numerals 57, 58, respectively, for yellow donor roller 52. If negatively charged toner is employed, then intermediate roller 56 will be charged positively to attract the toner, yellow donor 52 will be charged at a higher potential to attact the toner from roller 56 and color development roller 19 will be charged at a still higher potential to attract the toner from donor roller 52 for development of the latent electrostatic image. In a similar manner color development roller 19 will be biased to a higher potential than either of the donor rollers 53, 54 and black development roller 20 will be charged to a higher potential than black donor roller 55 to attract toner for development of the latent electrostatic image.

In operation, the paddle wheels 47 are rotated in the direction shown by the arrows to agitate the developer beds and create a toner cloud. The individual donor rollers 52, 53, 54 and 55 also are rotated in the direction shown by the arrows as well as intermediate roller 56, thereby enabling the bias potentials on the brushes to attract the toner particles in the toner cloud for proper toning of the development rollers 19, 20.

Figure 3:
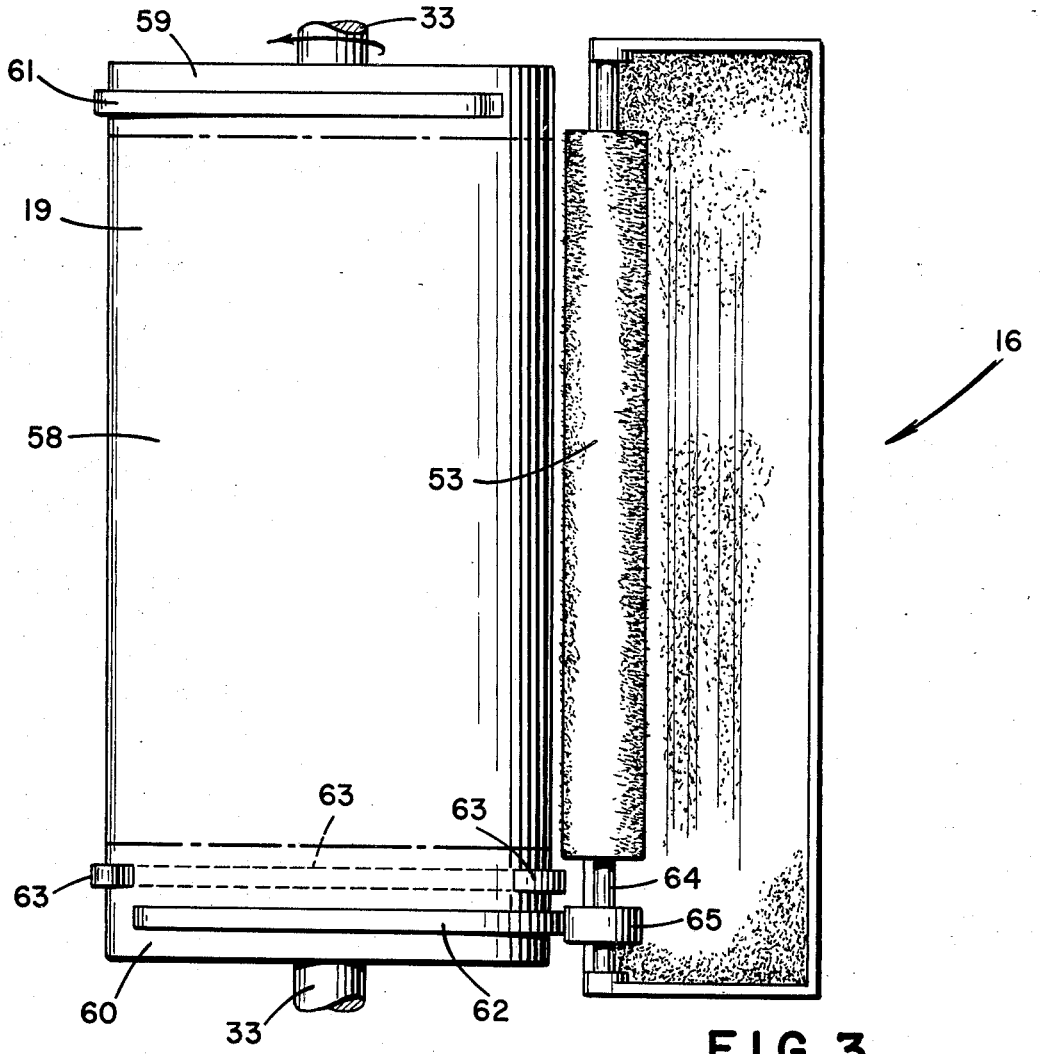
FIG. 3 is a top plan view of the color development roller showing several cams on the development roller and one color donor roll with a cam follower.
Figure 4:
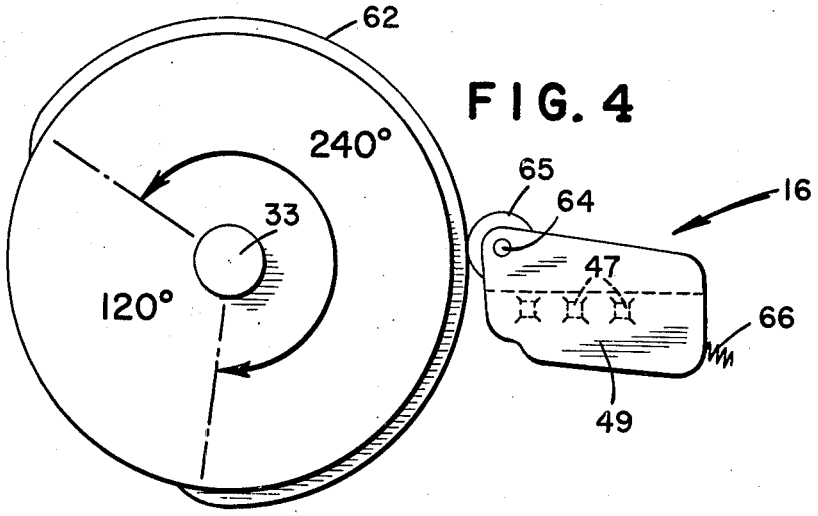
FIG. 4 shows an end view of the color development roller of FIG. 3 and one cam.
Figure 5:
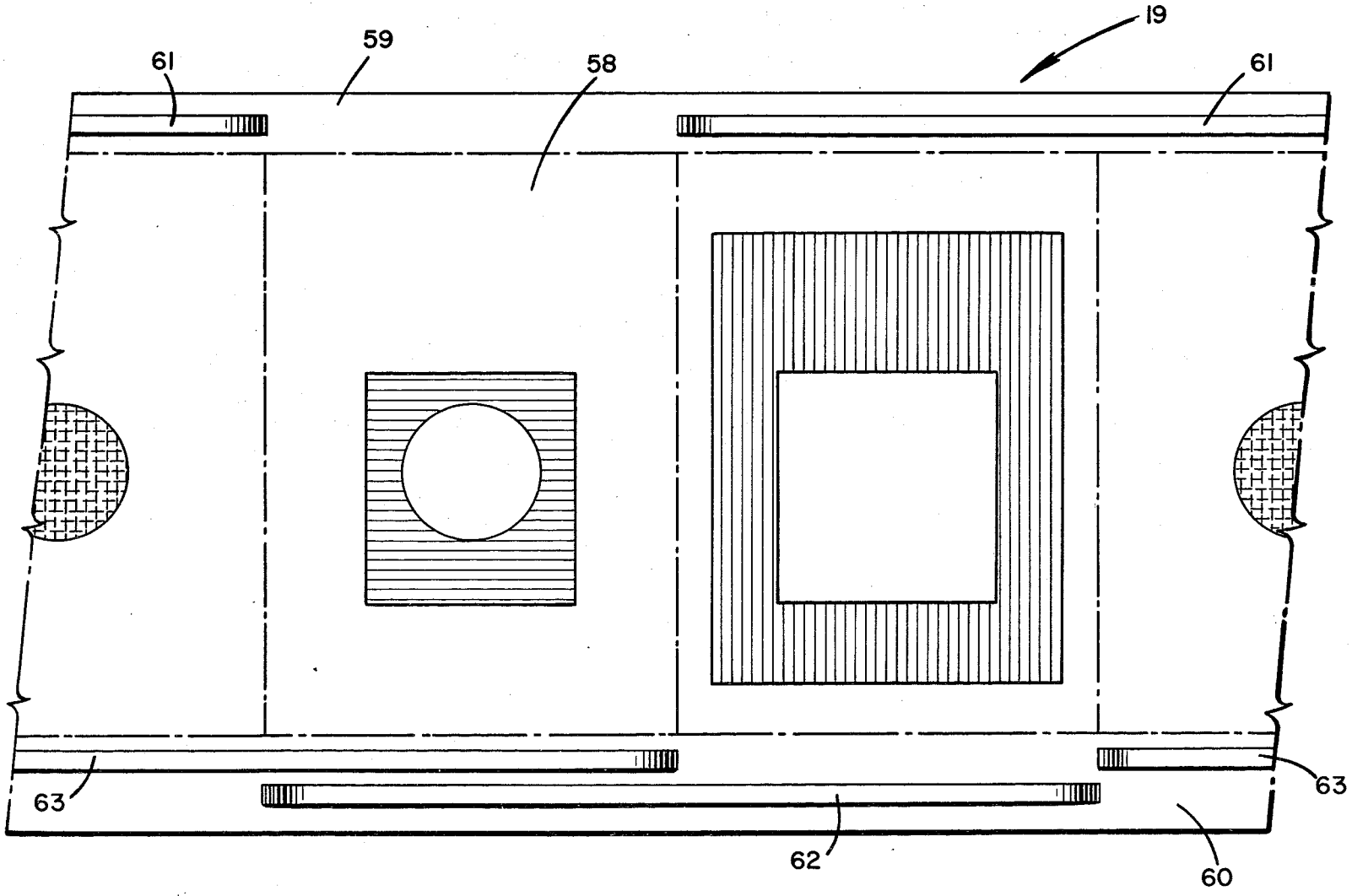
FIG. 5 is a diagrammatic lay-out of the cam and active development areas of the color development roller.

FIGS. 3, 4 and 5 illustrate the manner in which each of the donor rollers 52, 53, 54 is cammed in and out against the color development roller 19 to apply respective color toner at the proper time and position on roller 19. FIGS. 3 and 4 show structure for only one of the rollers, for example, roller 53 for applying magenta color toner, but this will be sufficient for an understanding of how yellow and cyan color toner are applied to the color development roller 19.

As shown in FIG. 3, color development roller 19 includes an active development area 58 where color toner is applied and non-development areas 59, 60 on either side of active development area 58. In non-development areas 59, 60 are located three cams 61, 62, 63, one for each of the color doner rollers 52, 53, 54. As indicated in FIG. 4, these cams each extend for an angle of 240° about the surface of roller 19. FIG. 4, for purposes of clarity, shows an end view of only one of the cams 62 extending for 240° about roller 19, with the non-cammed area of 120° corresponding to the angle over which the active development area will be provided with color toner.

FIG. 5 is a diagrammatic layout of the cam and toner application areas for color development roller 19. As shown any two of the three cams 61, 62 and 63 are positioned about the roller 19 to overlap each other and where they overlap there is a gap in the third cam corresponding to the 120° angle of toner application area relating to one of the color toners. Thus, if cams 61, 62 and 63 correspond, respectively, to cyan, magenta and yellow color toner, where cams 62, 63 overlap, cyan color toner will be applied to the active development area 58 of color development roller 19. Where cams 61, 62 overlap, yellow color toner will be applied and where cams 61, 63 overlap, magenta color toner will be applied to active development area 58.

FIGS. 3 and 4 also show in more detail the manner in which one of the color donor rollers, i.e., roller 53, is operated by the cam 62 to apply magenta toner to roller 19. Donor roller 53 rotates on a shaft 64 which is rotatably journeled at both ends into the housing of donor apparatus 16. Shaft 64 has near one end a cam follower 65 whose outside diameter is substantially equal to the outside diameter of donor roller 53. The entire apparatus 16 is spring biased by a spring 66 into contact with development roller 19. As development roller 19 rotates, cam follower 65 will ride up the surface of cam 62 for an angle of rotation of 240°. This will cause shaft 64 to apply a force to the housing of apparatus 16 at the ends of the shaft to overcome the biasing force of spring 66, thereby displacing donor roller 53 from contact with development roller 19 and preventing development of active development area 58 with magenta color toner. When cam follower 65 rides down the surface of cam 62 onto non-development area 60, the biasing force of spring 66 will bring donor roller 53 into contact with development roller 19 to apply magenta color toner for an angle of rotation of 120°. In the same manner, toner donor rollers 52, 54 will be biased into and out of contact with development roller 19 at the proper times through the use of respective cam followers 65 and biasing springs 66 to apply cyan and yellow color toners.

Figure 6:
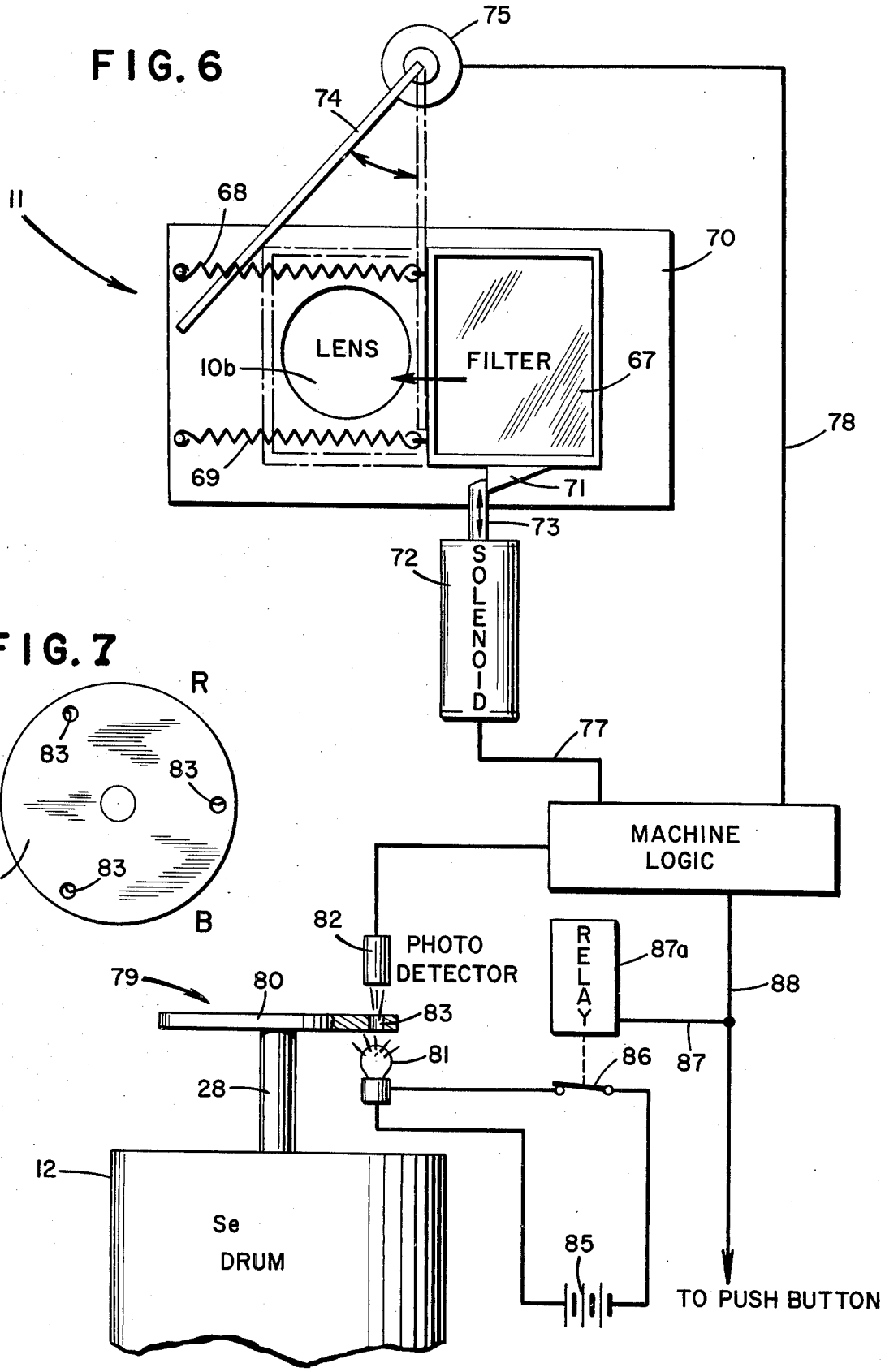
FIG. 6 illustrates, schematically, a block diagram of timing control for a filter system used in the present invention.
Figure 7:
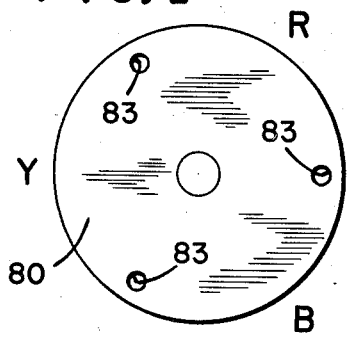
FIG. 7 shows part of the apparatus of FIG. 6.

FIGS. 6 and 7 illustrate schematically the structure for controlling imaging at the exposure station A. As shown in FIG. 6 a separation filter 67 is connected at its top and bottom to two springs 68, 69 which in turn are connected to the frame of a filter housing 70. Springs 68, 69 are biased to move filter 67 to the left as viewed in FIG. 6 to position the filter in front of the lens system 11. Filter 67 is held in the position shown to the right of the lens system **10*b* by means of a flange 71 extending from the bottom of the filter and a solenoid 72 which moves an arm 73 into and out of contact with flange 71. One filter 67 and one solenoid 72 are shown; however, it is to be understood that there are two other similar filters 67 and solenoids 72, thereby providing one separation filter and one solenoid for each of the three colors, connected as shown in FIG. 6.**

A swingable arm 74 is connected at one end to a rotary solenoid 75 to move the filters 67 from their position in front of the lens system to their stored position to the right of this system. Arm 74 extends widthwise across all three filters 67 so that only a single arm 74 is needed to return a filter to its stored position. Each of the three solenoids 72 and the rotary solenoid 75 are individually energized by signals from the outputs of a machine logic 76 which has output lines 77, 78 connected respectively to the solenoids.

A shaft encoder 79 including a rotating disc 80, lamp 81 and photodetector 82 is used to determine the position of shaft 28 on which photoconductive drum 12 rotates and hence to timely position the appropriate filter 67 in front of the lens system **10*b*. Photodetector 82 senses the light passing through the three apertures 83 located on disc 80 shown in FIG. 7 and generates control pulses which are coupled over line 84 to the machine logic 76. Lamp 81 is energized by a circuit including a battery 85 and normally closed switch 86 which is opened in response to a signal over line 87 when black and white reproduction is required, this signal also being fed as an input over line 88 to machine logic 76.**

For color copying switch 86 will be closed and lamp 81 will be on. As shaft 28 rotates drum 12 will be charged by the corona charge element 13. In addition, a first aperture 83 representative of, for example, a blue filter 67 used for developing with yellow color toner, will cross lamp 81 to allow light to illuminate photodetector 82. Photodetector 82 then will generate a first pulse that will be counted in machine logic 76 which will then generate a signal over a line 77 to the solenoid 72 associated with the blue filter 67. This solenoid 72 will be energized for a short period of time to withdraw arm 73, thereby allowing springs 68, 69 to move the blue filter 67 in front of lens system **10*b* to expose the drum 12** at exposure station A.

As shaft 28 continues to rotate, a second aperture 83 representative of, for example, a green filter 67, will pass in front of lamp 81 thereby causing machine logic 76 to count a second pulse. Machine logic 76 then will generate a signal first over line 78 to energize solenoid 75 and cause arm 74 to rotate to return blue filter 67 to its stored position. Machine logic 76 then will generate another signal over line 77 to energize the solenoid 72 associated with the green filter 67 for a short period of time. Arm 72 will then be withdrawn to release green filter 67 and enable springs 68, 69 associated therewith to draw this filter in front of lens system **10*b* for providing a second latent electrostatic image on drum 12** which will be developed with magenta color toner.

In a similar manner, as shaft 28 continues to rotate photodetector 82 will generate a third pulse when the third aperture passes in front of lamp 81. This third pulse will be counted by machine logic 76 to again energize solenoid 75 and solenoid 72 associated with red filter 67, thereby returning the green filter to its stored position and moving the red filter in front of lens system **10*b*. Thus, the third latent electrostatic image will be placed on drum 12** for development with cyan color toner. After counting three pulses the machine logic will reset itself in preparation for making another color copy.

It is of course to be understood that movement of the filters 67 in front of lengs system **10*b*, camming in and out of the color development apparatus 15, 16 and 17 as well as rotational movement of the photoconductor drum 12, color development roller 19 and transfer roller 21 are all synchronized to provide development and transfer of the proper color toner. Thus, for example, the apertures 83 of disc 80 and cams 61, 62, 63** will be so located with respect to each other that when a latent electrostatic image is produced by the blue filter, it will be developed with yellow toner.

For black and white reproduction, the operator may push a button (not shown) on the frame of the machine to send a signal over line 87 to energize a relay **87*a* which will open switch 86 thereby turning off lamp 81. In addition, this signal is fed over line 88 and detected by machine logic 76 to generate a signal over line 78. Solenoid 75 then will be energized to return whatever filter is in front of lens system 10*b* to its stored position. Since photodetector 82 cannot detect any illumination from lamp 81, none of the three solenoids 72 will be energized to release a filter 67. To return to color reproduction, the button for black and white reproduction may be again pressed to deenergize relay 87***a* thereby closing switch 86 and turning on lamps 81.

While the invention has been described with reference to the structure disclosed herein, it is not confined to the details set forth, but is intended to cover such modifications or changes as may come within the scope of the claims. Thus, for example, in lieu of the camming and nap fur brush system disclosed above, magnetic developing units and a programming system including a programming shaft of the type described in the above mentioned U.S. Pat. No. 3,724,943 may be employed for color and black and white reproduction.

What is claimed is:

1. Development apparatus for a multi-color electrostatic printing machine for producing copies of an original in which a plurality of electrostatic latent images are in series on a movable photoconductive member, comprising:

a. a color toner development roller for developing said plurality of electrostatic images, said color development roller applying different color toners to each of said latent electrostatic images, said color development roller applies said different color toners in sequence to each of said latent electrostatic images; and b. means for providing said different color toners on said color development roller, said means for providing provides each of said color toners onto a different area of the color development roller, said means for providing provides one color toner to the same area of the color development roller, this area to which the one color toner is provided being spaced from another area of said color development roller on which another color toner is provided, said color development roller having sequential areas of color toner thereon, said means for providing includes a plurality of color toner donor apparatus, each applying a different color toner to the color development roller and spaced about the periphery of the color development roller, said donor apparatus are movable and further comprising means for sequentially moving each of said color toner donor apparatus into and out of contact with said color development roller to provide said roller with the color toner. Said means for sequentially moving includes a plurality of cams, one for each of said color toner donor apparatus and located on the periphery of the color development roller; and a plurality of cam followers, one for each of said cams and connected to said donor apparatus.

2. The development apparatus of claim 1 wherein said donor apparatus and said color development roller include nap fur brushes.

3. Development apparatus for a multi-color electrostatic printing machine for producing copies of an original in which a plurality of electrostatic latent images are in series on a movable photoconductive member, comprising:

a. a first toner development roller for developing said plurality of electrostatic latent images with different color toners;

b. first means for supplying said color development roller with color toners;

c. a second toner development roller for developing said plurality of electrostatic latent images with a single color toner;

d. second means for supplying said second toner development roller with said single color toner; and e. means for moving either said first toner development roller or said second toner development roller into proximity with said photoconductive member to develop said plurality of electrostatic images either with said different color toners or said single color toner.

4. Development apparatus for a multi-color electrostatic printing machine for producing either color or black and white copies of an original in which a plurality of electrostatic latent images are formed in series on a rotatable photoconductive drum, comprising:

a. a color toner development roller for developing said plurality of electrostatic latent images with different color toners to produce a color copy;

b. first means for supplying said color development roller with said different color toners;

c. a black color toner development roller for developing said plurality of electrostatic latent images with black color toner to produce a black and white copy;

d. means for supplying said black development roller with black color toner; and e. means for moving either said color toner development roller or said black color toner development roller into contact with said photoconductive member to develop said plurality of electrostatic images.

5. The development apparatus of claim 4 wherein said color toner development roller and said black color toner development roller are moved into contact with said photoconductive drum at different parts of the periphery of the drum.

6. The development apparatus of claim 5 wherein said first means for supplying includes a plurality of color toner donor apparatus, each supplying a color toner and spaced about the periphery of the color toner development roller.

7. The development apparatus of claim 6 wherein the photoconductive drum and color toner development roller are of equal diameter and rotate at the same speed.

8. The development apparatus of claim 7 wherein each of said donor apparatus supplies color toner to separate areas of the color toner development roller.

* * * * *